US009283451B2

(12) United States Patent
Kammerer

(10) Patent No.: US 9,283,451 B2
(45) Date of Patent: Mar. 15, 2016

(54) GOLF CLUB ASSEMBLY AND GOLF CLUB HEAD WITH TENSION MEMBER

(71) Applicant: NIKE, Inc., Beaverton, OR (US)

(72) Inventor: Brian Kammerer, Fort Worth, TX (US)

(73) Assignee: NIKE, INC., Beaverton, OR (US)

( * ) Notice: Subject to any disclaimer, the term of this patent is extended or adjusted under 35 U.S.C. 154(b) by 0 days.

(21) Appl. No.: 13/905,794

(22) Filed: May 30, 2013

(65) Prior Publication Data

US 2013/0337932 A1 Dec. 19, 2013

Related U.S. Application Data

(60) Provisional application No. 61/654,062, filed on May 31, 2012.

(51) Int. Cl.

| | |
|---|---|
| ***A63B 53/04*** | (2015.01) |
| ***A63B 53/00*** | (2015.01) |
| *A63B 53/06* | (2015.01) |

(52) U.S. Cl.

CPC ..... *A63B 53/0487* (2013.01); *A63B 53/007* (2013.01); *A63B 53/065* (2013.01); *A63B 53/04* (2013.01); *A63B 53/06* (2013.01); *A63B 60/54* (2015.10); *A63B 2053/0408* (2013.01); *A63B 2053/0433* (2013.01); *A63B 2209/02* (2013.01)

(58) Field of Classification Search

CPC ..... A63B 53/04
USPC ..... 473/340
See application file for complete search history.

(56) References Cited

U.S. PATENT DOCUMENTS

| | | | | |
|---|---|---|---|---|
| 3,888,492 | A * | 6/1975 | Cabot | 473/255 |
| 6,517,450 | B1 * | 2/2003 | Klyve | 473/340 |

* cited by examiner

*Primary Examiner* — Michael Dennis
(74) *Attorney, Agent, or Firm* — Banner & Witcoff, Ltd

(57) ABSTRACT

A golf club head includes a body, a first arm and a second arm. The body has a ball striking face for striking a golf ball and extends from a heel-side to a toe-side. The first arm projects rearwardly from the body. The second arm also projects rearwardly from the body. The second arm is spaced from the first arm in a heel-to-toe direction to thereby define a gap. The club head further includes a tension member spanning the gap between the first and second arms. The tension member has a first end attached to the first arm and a second end attached to the second arm. The tension member may be pre-tensioned, thereby imparting increased rigidity to the club head. A golf club, particularly a putter, may be provided with this club head.

20 Claims, 5 Drawing Sheets

GOLF CLUB ASSEMBLY AND GOLF CLUB HEAD WITH TENSION MEMBER

RELATED APPLICATIONS

This application claims the benefit of priority of U.S. Provisional Application No. 61/654,062, filed May 31, 2012, the contents of which are hereby incorporated by reference in its entirety.

FIELD OF THE INVENTION

The invention relates generally to golf clubs and golf club heads. Golf club heads, in accordance with at least some examples of this invention, may be constructed to include a tension member.

BACKGROUND

Golf is enjoyed by a wide variety of players—players of different genders and players of dramatically different ages and skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with increased availability of golf programming on television (e.g., golf tournaments, golf news, golf history, and/or other golf programming) and the rise of well-known golf superstars, at least in part, have increased golf's popularity in recent years both in the United States and across the world.

Golfers at all skill levels seek to improve their performance, lower their golf scores, and reach that next performance "level." Manufacturers of all types of golf equipment have responded to these demands, and recently, the industry has witnessed dramatic changes and improvements in golf equipment. For example, a wide range of different golf ball models now are available, with some balls designed to complement specific swing speeds and/or other player characteristics or preferences, e.g., with some balls designed to fly farther and/or straighter, some designed to provide higher or flatter trajectories, some designed to provide more spin, control, and/or feel (particularly around the greens), etc.

Being the sole instruments that set golf balls in motion during play, golf clubs also have been the subject of much technological research and advancement in recent years. For example, the market has seen improvements in putter designs, golf club head designs, shafts, and grips in recent years. Additionally, other technological advancements have been made in an effort to better match the various elements and/or characteristics of the golf club and/or characteristics of a golf ball to a particular user's swing features or characteristics (e.g., club fitting technology, ball launch angle measurement technology, ball spin rate characteristics, etc.).

Golfers tend to be sensitive to the "feel" of a golf club, particularly with respect to putters. The "feel" of a golf club comprises the combination of various component parts of the club and various features associated with the club that produce the sensory sensations experienced by the player when a ball is swung at and/or struck. Club "feel" is a very personal characteristic in that a club that "feels" good to one user may have totally undesirable "feel" characteristics for another. Club weight, weight distribution, aerodynamics, swing speed, and the like all may affect the "feel" of the club as it swings and strikes a ball. "Feel" also has been found to be related to the visual appearance of the club and the sound produced when the club head strikes a ball to send the ball in motion.

To successfully putt a ball in the hole, the ball must be launched at the proper combination of speed and direction to arrive at the intended destination. While some errors in putt speed and direction may be the result of mental or physical mistakes by the player (e.g., off-center hits, misaligned club heads, etc.), the putter also can contribute to inconsistencies in ball launch speed and launch direction that result in missed putts. For example, if the putter head twists in the player's hands before or during ball contact, this may cause the ball to start out "off-line," with some undesired spin and/or at the wrong speed. As another example, if the ball is launched with backspin or bounces excessively during the early phase of its locomotion, this can cause inconsistencies in ball speed. All of these things may result in missed putts and inconsistent putting.

In an attempt to increase club head stability, certain putters have been provided that redistribute weight from the centerline to the heel and the toe regions, thereby increasing the moment of inertia. However, certain putter designs of this type tend to produce an unpleasant vibration or ringing feel when the ball is hit.

While technological improvements to putter designs have been made, because of the very personal nature of the putting stroke and the "feel" aspects of putting a golf ball, no single putter structure is best suited for all players. New putter structures that change the look and feel of the club are welcomed by at least some players. Moreover, technological advances that provide improved and more consistent ball initial launch direction and launch speed would be a welcome advance in the art.

SUMMARY

The following presents a general summary of aspects of the invention in order to provide a basic understanding of this invention. This summary is not intended as an extensive overview of the invention. It is not intended to identify key or critical elements of the invention or to delineate the scope of the invention. The following summary merely presents some concepts of the invention in a general form as a prelude to the more detailed description provided below.

The invention may be used to provide a golf club head with a tension member. In accordance with a first aspect, a golf club head includes a body having a first arm extending rearwardly therefrom and a second arm extending rearwardly therefrom. A tension member has a first end connected the first arm and a second end connected to the second arm. The tension member is in tension such that the first arm is biased toward the second arm.

In accordance with another aspect, a golf club head includes a body having a striking face for engaging a golf ball, the body extending from a heel-side to a toe-side. First and second arms may project rearwardly from the body. The second arm may be spaced from the first arm in a heel-to-toe direction to thereby define a gap. At least one strand spans the gap, the strand having a first end attached to the first arm and a second end attached to the second arm.

In accordance with even another aspect, a system for a golf club head may include a body having a striking face for engaging a golf ball, with the body extending from a heel-side to a toe-side. The club head may further include first and second arms extending rearwardly from the body. The second arm may be spaced from the first arm in a heel-to-toe direction to thereby define a gap. A tension member having first and second ends may be configured to span the gap, wherein the first and second arms are configured to engage and retain the first and second ends of the tension member such that the tension member would be pre-tensioned. The system may further include a second tension member configured to span the gap and having first and second ends, wherein the first and second arms are configured to engage and retain the first and second ends of the second tension member interchangeably with the first tension member.

In accordance with a further aspect, a golf club assembly includes a shaft and a club head secured to a distal end of the shaft. The golf club head includes a body having a first arm and a second arm extending rearwardly therefrom. A tension member has a first end connected the first arm and a second end connected to the second arm. The tension member is in tension such that the first arm is biased toward the second arm.

Substantial advantage may be achieved by providing a putter-type golf club head with a tension member extending between rearwardly projecting arms. In particular, an increased moment-of-inertia and optimized center-of-gravity may be possible, while providing the feel and sound that golfer's expect when hitting the golf ball. These and additional features and advantages disclosed here will be further understood from the following detailed disclosure of certain embodiments.

BRIEF DESCRIPTION OF THE DRAWINGS

A more complete understanding of the present invention and certain advantages thereof may be acquired by referring to the following detailed description in consideration with the accompanying drawings.

Figure 1A:
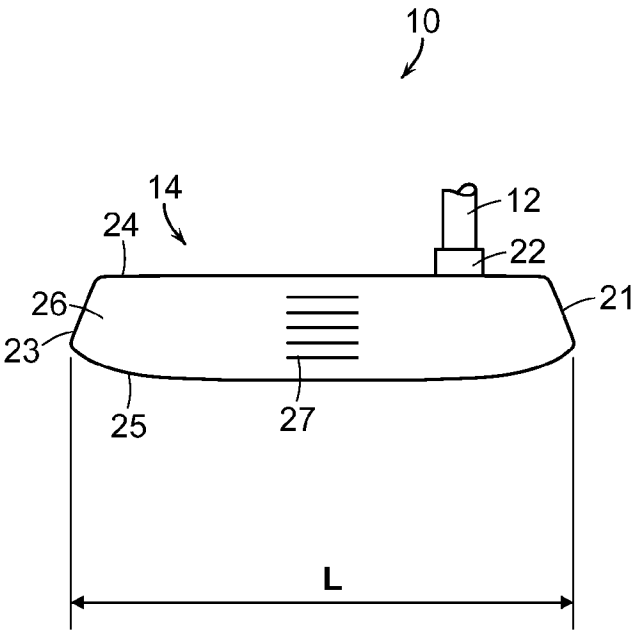
FIG. 1A illustrates a front view of a golf club having a golf club head in accordance with certain aspects.

The figures referred to above are not drawn necessarily to scale, should be understood to provide a representation of particular embodiments of the invention, and are merely conceptual in nature and illustrative of the principles involved. Some features of the golf club with a tensioned member depicted in the drawings have been enlarged or distorted relative to others to facilitate explanation and understanding. The same reference numbers are used in the drawings for similar or identical components and features shown in various alternative embodiments. Golf clubs with a tension member as disclosed herein would have configurations and components determined, in part, by the intended application and environment in which they are used.

DETAILED DESCRIPTION

A general description of aspects of the invention followed by a more detailed description of specific embodiments follows. In the following description of various example golf club heads and other aspects of this invention, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized and structural and functional modifications may be made without departing from the scope of the present invention.

A. General Description of Golf Clubs and Golf Club Heads According to Aspects of the Invention For purposes of this disclosure, and referring to FIGS. 1A and 1B, with a club head at an address position, a length (L) of the club head extends from the outermost point of the toe to the outermost point of the heel. A breadth (B) of the club head extends from the outermost point of the face to the outermost point of the rear. A vertical plane associated the outermost point of the face may be referred to as the "front plane" of the club head. The terms "above," "below," "upper," "lower," "top," "bottom," "front," "back," "rear," "side," "heel-side," "toe-side," etc. all may refer to views associated with the club head when it is in the address position. For purposes of this disclosure, unless otherwise indicated, "length" measurements or dimensions of the club head are taken parallel to the front plane of the club head and parallel to the ground. "Breadth" measurements or dimensions of the club head are taken parallel to the centerline of the club head and parallel to the ground. "Height" measurements or dimensions of the club head are taken parallel to a vertical plane when the club head is in its address position.

As noted above, golf club head and golf club structures in accordance with at least some examples of this invention may include one or more arms projecting rearwardly from the a main body portion. The body may have a ball striking face for striking a golf ball. Further, the body extends from a heel-side to a toe-side. A first arm projects rearwardly from the body, and a second arm projects rearwardly from the body. The second arm is spaced from the first arm in a heel-to-toe direction to thereby define a gap. A tension member spans the gap. Specifically, a first end of the tension member is attached to the first arm and a second end of the tension member is attached to the second arm.

According to some aspects, the arms are cantilevered from the body, i.e., the arms are fixedly attached to the body and extend rearwardly to a free end. The arms may extend straight back, thereby forming a roughly rectangular-shaped club head, when viewed from above. Optionally, the arms may converge as they extend toward the rear of the club head. Conversely, the arms may diverge as they extend from the body. According to certain embodiments, one or both of the arms may be substantially straight. Optionally, one or more of the arms may be curved and/or bent.

According to other aspects, one of the arms may be attached to the body at the extreme heel-side edge of the body and the other of the arms may be attached at the extreme toe-side edge of the body. Optionally, one or the other of the arms may be positioned inboard of the heel- and toe-side edges of the body. For example, if the body is divided into three equal heel-to-toe dimension regions—a heel region, a central region, and a toe region, the first arm may extend from the heel region of the body and the second arm may extend from the toe region of the body.

According to some embodiments, the rearward end of at least one of the arms may be located at least 40 mm in a breadthwise direction from the striking face. Even longer arms may be provided, such that rearward end of at least one of the arms may be located at least 50 mm, at least 60 mm or even at least 70 mm in a breadthwise direction from the striking face. Further, the arms may have an evenly distributed mass or an unevenly distributed mass. For example, if an arm is divided into three equal front-to-rear dimension portions—a front portion, a mid-portion, and a rear portion, a mid-portion of an arm may have a cut-out to reduce the mass in that mid-portion, while maintaining a greater mass at the rear portion. As another example, the rear portion of an arm may be formed of a denser material than the front portion of the arm, thereby increasing the mass in the rear portion relative to the front portion.

According to certain aspects, the tension member is pre-tensioned such that the first and second arms are biased (or pulled) toward one another. The tension in the tension member places other components of the club head in bending and/or compression. Essentially, the rigidity of the club head is increased by the creation of opposing, isometric-type loads.

The tension member may dampen or attenuate vibrations throughout the club head and shaft when a ball is contacted by the club head. As a particularly advantageous aspect, the tension member may allow greater control over the weighting characteristics of the club head (e.g., center of gravity location, moment of inertia characteristics, etc.). Specifically, weight that may have previously been used to control the vibration characteristics of the club head may now be used to provide better weighting characteristics (i.e., shifting center of gravity rearward and/or increasing the moment of inertia without increasing the overall mass of the club head).

According to certain embodiments, the tension member may be initially tensioned or pre-tensioned to more than 100 N, more than 500 N, more than 1000 N, or more than 1500 N. For certain more highly tensioned embodiments, the tensioned element may be pre-tensioned more than 2000 N, more than 2500 N, or even more than 3000 N. For certain very highly tensioned embodiments, the tensioned element may be pre-tensioned to more than 3500 N, more than 4000 N, or even up to 4500 N. Thus, a tension member may be initially tensioned from approximately 100 N to approximately 4500 N.

Generally, a pre-tensioned element is capable of reacting or carrying additional tension loading (up to a tensile failure load), while also being capable of reacting or carrying compression loading (at least equal to the pre-tensioned load). Thus for flexible tension members, if the applied compressive loading exceeds the pre-tensioned load, the pre-tensioned element becomes untensioned or limp and unable to carry further compressive loads.

According to other embodiments, the tension member need not be pre-tensioned, i.e., the tension member need not be significantly tensioned in the initial, resting configuration. For example, a tension member may have an initial tension of approximately zero. In some embodiments, when the tension member is very flexible when unrestrained, a small initial tension load may be applied to remove any visible slack in the tension member.

According to certain embodiments, a tension member may be an element that is not capable of carrying compression loads when in a non-tensioned state. For example, a tension member may be formed as one or more strands. For purposes of the present disclosure, a "strand" includes a wire, a cable, a cord, a filament, a chain, etc., i.e., a "strand" is a long, thin, essentially one-dimensional, flexible element that can carry tension loads, but not compression loads. Essentially, a "strand" may be capable of being coiled when in an unloaded, unrestrained configuration. Further, for purposes of the present disclosure a "plurality of strands" spanning the gap between the first and second arms may actually be formed from a single continuous strand element that is configured to extend back and forth between the two arms. In other words, for example, a single continuous wire that is looped back upon itself so that it extends across the gap twice, thrice, or more, would form a "plurality of strands." The tension member may be formed of any number of different materials suitable for carrying a tension load. For example, wires may be formed of a metal or a metal alloy.

According to other embodiments, the tension member may be a sheet-like element, i.e., a thin, essentially two-dimensional, flexible element. For purposes of the present disclosure, a "sheet-like element" can carry tension loads, but not compression loads. In other words, similar to a strand, a sheet-like element is non-load carrying when in a non-tensioned state. A "sheet-like element" may be capable of being rolled when in an unloaded, unrestrained configuration. Such a sheet-like element may have thin wires or other one-dimensional tension elements embedded within a fabric, matrix, layer, film, etc. For example, wires or other filaments may be provided as part of a reinforced textile material.

According to even other embodiments, the tension member may be a thin, relatively flexible, elongated element. For example, the tension member may be provided as one or more rods that are pre-tensioned when engaged with the arms. The rods may have any cross-sectional shape. Alternatively, the tension member may be provided as one or more thin plates that are pre-tensioned when engaged with the arms. These rod-like and/or plate-like elements are slightly less flexible than the strand elements and sheet-like elements described above. Unlike the very flexible strand elements and sheet-like elements, in a non-tensioned condition these particular rod-like and plate-like tension members may be capable of reacting or carrying some slight compression load. These rod-like elements or plate-like elements would typically be expected to buckle under relatively small compressive loads. However, for purposes of this disclosure, these rod-like and plate-like elements are considered to be tension members because, when engaged with the arms of the club head, these tension members are placed in an initial, pre-tensioned condition. For purposes of this disclosure, these tension members may be referred to as "tension/buckling tension members."

Any desired material(s) may be used for the tension members without departing from this invention, including, for example, any metal and/or metal alloy, polymer materials such as nylon, polyester, Kevlar, etc., and/or composite materials including carbon-fiber, fiberglass, boron, ceramics, metal matrix, etc. According to certain embodiments, tension member maybe formed as a spring steel wire.

According to certain aspects, the tension member may be engaged to the arms at any point or portions along the breadth dimension of the arm. In certain embodiments, the tension member may be attached toward the very rear of the arms. For example, at least a portion of the tension member may be attached to at least one of the first and second arms in a rearward third portion of the total breadth of the club head. Further, according to other aspects, the club head may include a second tension member having a first end attached to the first arm and a second end attached to the second arm. The second tension member may be attached to the arms in the same portion as the first tension member, or to a different portion of the arms.

According to even other embodiments, more than two arms may be provided. For example, the first arm may be positioned in the heel region of the body and the second arm may be positioned in the central region of the body. A first tension element may extend across a gap between these first and second arms. Additionally, a third arm may be positioned in the toe region of the body. A second tension element may extend across a gap between the second and third arms. Further, should the second arm for example be shorter than the first and third arms, a tension element may extend across the gap between the first and third arms.

According to certain aspects, a system for a golf club head includes a body having arms configured to engage and retain first and second ends of a tension member. A tension member configured to span the gap defined between the arms and having first and second ends for engaging the first and second arms is provided. Additionally, according to at least some embodiments, the tension member may be configured to be detachably attached to the first and second arms. A second tension member configured to span the gap and configured to be detachably attached to the first and second arms may also be provided. Thus, the first and second tension members may be configured for interchangeable attachment to the arms. And, correspondingly, the first and second arms may be configured to engage and retain the first and second ends of the second tension member interchangeably with the first tension member.

The club head may be made from a variety of different materials without departing from this invention, including a metal material or metal alloy, such as aluminum, titanium, alloys of aluminum and/or titanium, stainless steel, copper, copper alloys, etc. Other materials such as graphite, polymers, plastics, composite materials (including fiberglass composites, carbon composites, Kevlar composites, etc.), metal matrix, ceramics, etc. may also be used. The club head may be integrally formed, for example, by casting, forging, molding, etc. or may be formed from any overall number of parts and pieces that are subsequently joined to one another.

At least some example aspects of this invention relate to putters and putter heads, as well as to systems for putter heads. Thus, according to certain embodiments, the club is a putter and the length (L) of the putter head may be greater than 110 mm. By way of one example, the putter head length (L) may be greater than or equal to approximately 120 mm, greater than or equal to approximately 130 mm, or even greater than or equal to approximately 140 mm. According to further embodiments, the breadth (B) of the putter head may be greater than 80 mm. For example, the putter head breadth (B) may be greater than or equal to approximately 90, greater than or equal to approximately 95 mm, greater than or equal to approximately 100 mm, or even greater than or equal to approximately 105 mm.

According to other aspects, the ratio of the breadth dimension (B) of a putter head to the length dimension (L) (i.e., ratio "B/L") may be at least 0.55, and in some examples, this ratio may be at least 0.60, at least 0.65, at least 0.70, at least 0.75, at least 0.80, at least 0.85, or even at least 0.90.

It is expected that a putter head having tension member will have improved moment-of-inertia (MOI) characteristics. For example, it is expected that the moment-of-inertia around a vertical axis associated with the club head's center-of-gravity may be greater than 4500 g-cm$^2$, greater than 4800 g-cm$^2$, greater than 4900 g-cm$^2$, or even greater than 4000 g-cm$^2$. Further, it is expected that the moment-of-inertia around a horizontal axis associated with the club head's center-of-gravity may be greater than 2500 g-cm$^2$, greater than 2700 g-cm$^2$, or even greater than 2900 g-cm$^2$. The vertical (z) axis and the horizontal (x) axis are defined with the club head in the 60° lie angle position.

Additionally, the center of gravity (CG) of a putter head may be located at least approximately 40 mm, at least approximately 45 mm, or even at least approximately 50 mm from the front face.

In general, aspects of the present invention relate to systems for providing golf club heads, or other ball striking devices, that better control the mass properties of the individual golf club heads, thereby providing greater flexibility and customizability in the design of the overall golf club. Further, it can be seen that the dimensions and/or other characteristics of golf club head structures according to aspects of this invention may vary significantly without departing from the invention.

Specific examples of the invention are described in more detail below. The reader should understand that these specific examples are set forth merely to illustrate examples of the invention, and they should not be construed as limiting the invention.

B. Specific Examples

The various figures in this application illustrate examples of golf clubs, components thereof, and methods in accordance with examples of this invention. When the same reference number appears in more than one drawing, that reference number is used consistently in this specification and the drawings to refer to the same or similar parts throughout.

Figure 1B:
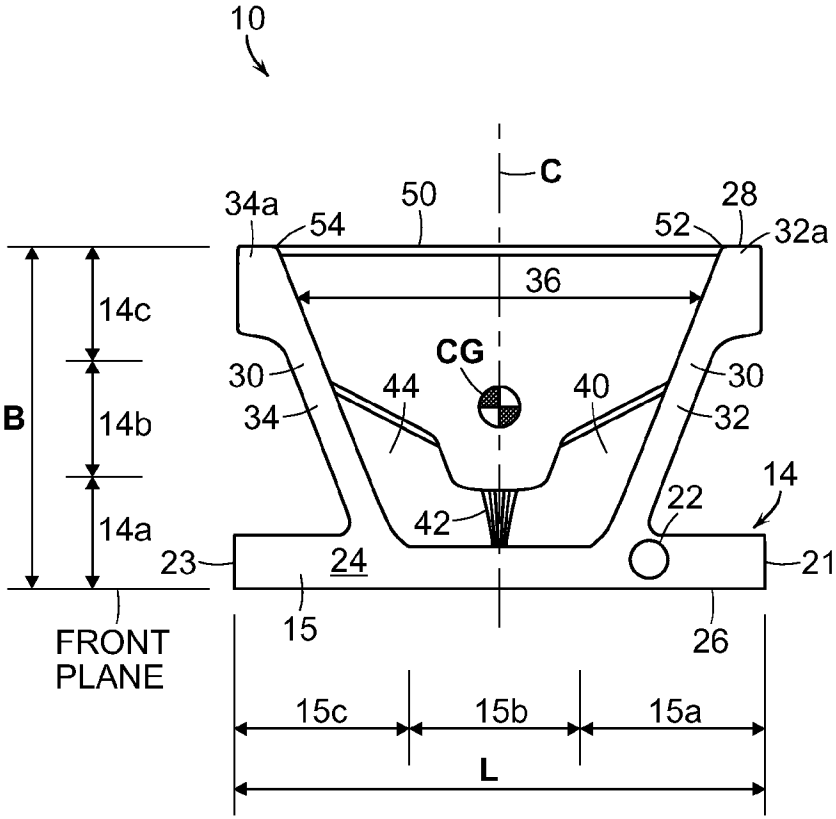
FIG. 1B illustrates a top view of the golf club head of FIG. 1A.

Referring to FIGS. 1A-1B, an embodiment of a golf club 10 includes a shaft 12 and a golf club head 14. Shaft 12 of golf club 10 may be made of various materials, such as steel, aluminum, titanium, graphite, or composite materials, as well as alloys and/or combinations thereof, including materials that are conventionally known and used in the art. Additionally, the shaft 12 may be attached to the club head 14 in any desired manner, including in conventional manners known and used in the art (e.g., via adhesives or cements at a hosel 22, via fusing techniques (e.g., welding, brazing, soldering, etc.), via threads or other mechanical connectors, via friction fits, via retaining element structures, etc.). A grip or other handle element (not shown) may be positioned on shaft 12 to provide a golfer with a slip resistant surface with which to grasp golf club shaft 12. As shown in FIGS. 1A-1B, golf club 10 may be a putter in one exemplary embodiment.

Club head 14 includes a plurality of regions. As shown in FIGS. 1A and 1B, the golf club head 14 comprises a body 15 that includes a heel 21 and toe 23, the body 15 extending between the heel 21 and the toe 23. The hosel 22 for connecting the shaft 12 to the golf club head 14 is provided. The body 15 also includes a top portion 24 and a bottom portion 25. A ball striking face 26 extends between the top portion 24 and the sole portion 25 and between the toe 23 and the heel 21. The striking face 26 provides a contact area for striking and propelling a golf ball in an intended direction. The striking face 26 may include grooves 27 for the removal of water, etc. from the striking face 26 and/or for gripping the golf ball. Alternatively, the striking face 26 may be smooth. Further, the ball face 26 may be flat, or it may include some roll or bulge characteristics, and/or it be provided with a loft characteristic. The body 15 of golf club head 14 may be constructed of various materials such as steel, titanium, aluminum, tungsten, graphite, polymers, plastics, composites etc. and combinations thereof.

For purposes of this disclosure and referring to FIG. 1B, body 15, which extends between heel 21 and toe 23, may be divided into three regions: a heel region 15*a*, a central region 15*b* and a toe region 15*c*. The heel region 15*a*, the central region 15*b* and the toe region 15*c* may each comprise one-third of a total length (L) of body 15. Club head 14 has a center of gravity (CG) located approximately 50% of the length (L). A centerline (C) is associated with the center of gravity. Further, the overall breadth dimension of the club head 14, which extends between striking face 26 and rear 28, may be divided into three regions: a front region 14*a*, a mid-region 14*b* and a rear region 14*c*. The front region 14*a*, the mid-region 14*b* and the rear region 14*c* may each comprise one-third of a total breadth (B) of club head 14.

According to certain aspects, the club head 14 further includes arms 30 that project rearwardly from body 15. Arms 32 and 34 may be integrally formed with the body 15, or they may be joined to a rear surface of body 15. As shown in FIG. 1B, a first arm 32 is provided toward the heel-side of club head 14 and a second arm 43 is provided toward the toe-side of club head 14. Second arm 34 is spaced apart in a heel-to-toe direction from first arm 32. A gap 36 that extends through the height of club head 14 is defined between the arms 32, 34. In this particular embodiment, arms 32 and 34 diverge from each other as they extend rearwardly from body 15 and, correspondingly, gap 36 increases as it extends away from body 15. In this particular embodiment, arms 32 and 34 extend at an angle of 70 degrees (±10 degrees) from the plane of the striking face 26. As illustrated in FIG. 1B, body 15, first arm 32, and second arm 34 cooperate to form a substantially rectangular-shaped club head 14.

Other configurations of body 15 and first and second arms 32, 34 may form a variety of other club head shapes, as would be apparent to persons of ordinary skill in the art, given the benefits of this disclosure. For example, in other embodiments, the arms 32 and 34 may extend at various other angles from the plane of the striking face 26 (including angles ranging from 45 degrees to 120 degrees, from 50 degrees to 90 degrees, from 60 degrees to 90 degrees, or even from 90 degrees to 120 degrees). Thus, in certain embodiments, arms 32, 34 may be generally normal to the ball striking face 26 and project generally straight back wherein the arms 32, 34 are generally parallel to one another. According to some embodiments, arms 32, 34 may be essentially symmetric, mirror-images of each other. While in other embodiments, arms 32, 34 may be non-symmetric. As another example, the particular cross-sectional shape of the individual arms 32, 34 may be the same or different. As a further example, the particular angle by which the individual arms 32, 34 project from the body 15 may be the same or different. Even further, the individual arms 32, 34 need not extend in a single straight line (whether or not one or both of them extend at an angle), but may have a curved or piecewise linear extension. Additionally, the cross-sectional area and moment-of-inertias of the individual arms 32, 34 may vary or remain constant along the length of the arms or along portions of the length of the arms.

In the particular embodiment of the club head of FIGS. 1A and 1B, arms 32 and 34 have a generally rectangular cross-sectional shape over a majority of their length. Over approximately the rearward third of their length, the cross-sectional area of arms 32 and 34 is increased. Thus, the mass of the arms 32, 34 is unequally distributed, being greater at the ends 32*a*, 34*a* than along the forward two-thirds of their length. According to other embodiments, a greater mass at the ends of arms 32, 34 may be achieved by using a denser material, rather than by increasing the volume. Further, in this particular embodiment, when viewed from above, the inner edges of the first and second arms 32, 34 are straight and the outer edges of the arms 32, 34 generally extend parallel to the inner edges, at least along a majority of their length.

According to other aspects and referring to FIG. 1B, body 15 may include an intermediate plate 40 extending between arms 32 and 34. This plate 40 may be integrally formed with arms 32 and 34 and/or with body 15, or it may be formed separate from these members. In this illustrated example, plate 40 includes an alignment indicator 42. In general, any of various alignment indicators 42 as would be known to persons of ordinary skill in the art may be provided on plate 40, if desired.

Further, plate 40 may be provided as a sole plate 44, in which case it would extend rearwardly from a lower edge of body 15. In the illustrated example, sole plate 44 extends rearwardly to approximately a mid-portion of each of first arm 32 and second arm 34. In such an embodiment, when viewed from above, an upper surface of sole plate 44 is exposed to an exterior of club head 14 through gap 36 formed between first arm 32 and second arm 34. The remainder of gap 36 positioned rearward of sole plate 44 is unobstructed and provides a clear visual path vertically through club head 14.

According to certain aspects and as shown in FIG. 1B, golf club head 14 may include a tension member 50 positioned behind striking face 26. Tension member 50 spans gap 36 and extends between first arm 32 and second arm 34. In this particular embodiment, tension member 50 is a rod 50*a* having a first end 52 connected to a rearward, free end 32*a* of first arm 32 and a second end 54 connected to a rearward, free end 34*a* of second arm 34. The gap-spanning dimension of rod 50*a* may be made shorter than the free length dimension of gap 36, such that when rod 50 is attached to arms 32, 34, free ends 32*a*, 34*a* of arms 32, 34 are pulled together, thereby pre-tensioning rod 50*a*. As a means of attachment, ends 52, 54 of rod 50*a* may be threaded ends which are inserted into through holes in ends 32*a*, 34*a* of arms 32, 34 and secured with threaded nuts. Alternatively, as another example, ends 52, 54 of rod 50*a* may be enlarged such that when slidingly inserted into slots in ends 32*a*, 34*a*, the enlarged ends engage complementarily sockets in arms 32, 34. During the insertion process, ends 32*a* and 34*a* may be forced toward each other. When the enlarged ends of rod 50*a* are engaged with the complementary sockets, arms 32 and 34 may be released, allowing ends 32*a*, 34*a* to move apart, thereby pre-tensioning rod 50*a*.

According to certain aspects, plate 40 may be provided as a relatively compressible material, such that when tension member 50 is pre-tensioned and arms 32 and 34 are biased toward one another, plate 40 is compressed. For example, plate 40 may include a plastic or polymeric material and/or even an elastomeric material. This may even further provided beneficial damping characteristics.

Other various configurations of tension members 50, the placement of tension members 50 relative to body 15 and arms 30, and the means for attaching tension members 50 to arms 30 will be apparent given the benefit of the present disclosure. FIGS. 2-8 described below, provide other non-limiting examples of some of the various embodiments of tension members 50 in order to illustrate certain aspects.

Thus, as other embodiments of a club head, for example referring to FIGS. 2-5, arms 30 extend rearwardly from proximate the heel and proximate the toe of the body 15. Arms 32, 34 are substantially mirror images of each other. Further, arms 32, 34 are substantially symmetrically positioned with respect to the centerline (C). In these embodiments, arms 32 and 34 may have a generally rectangular cross-sectional shape from top to bottom. Over the rearward two-thirds of their breadthwise dimension, the cross-sectional area of arms 32 and 34 increases as they extend toward the rear. Further, in this particular embodiment, the outer edges of the first and second arms 32, 34 generally extend straight back while the inner edges converge slightly toward each other due to the increasing cross-sectional area.

Figure 2:
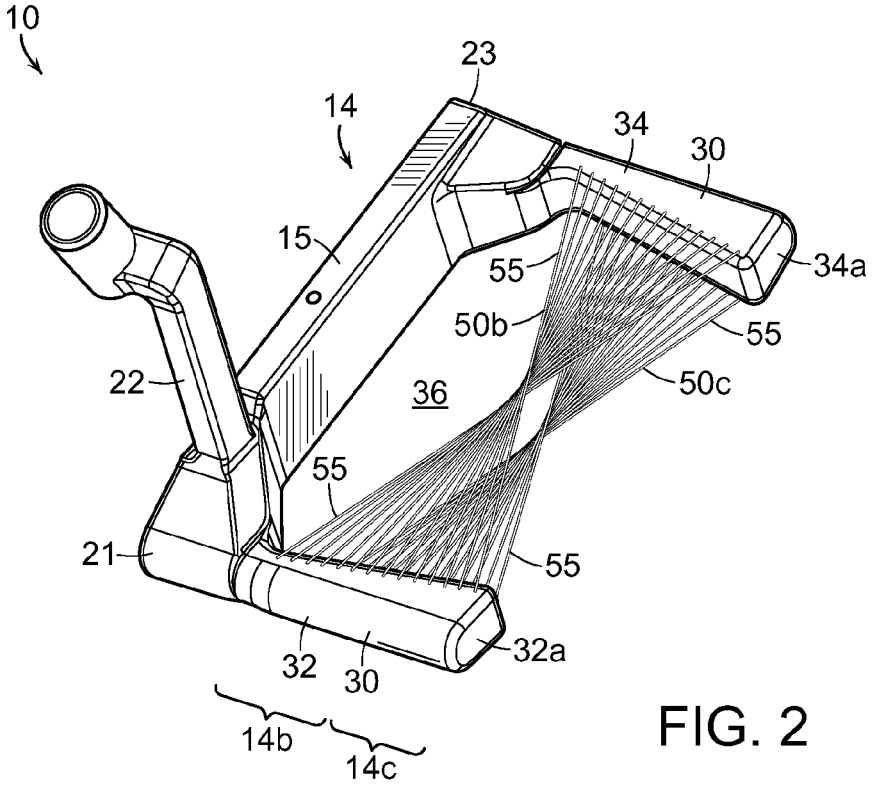
FIGS. 2-5 illustrate various embodiments of golf club heads, taken from a rear perspective view, with tension members in accordance with certain aspects.
Figure 3:
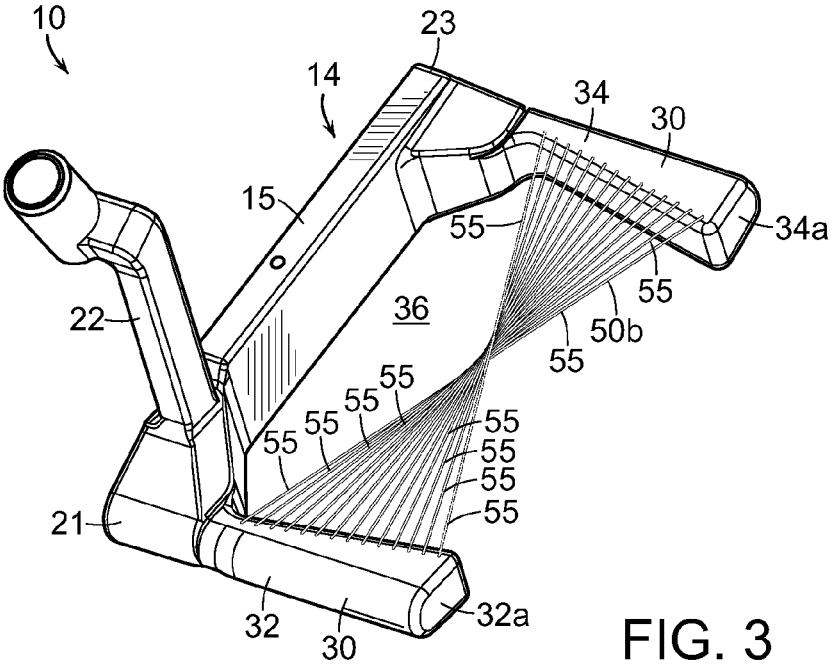
Figure 4:
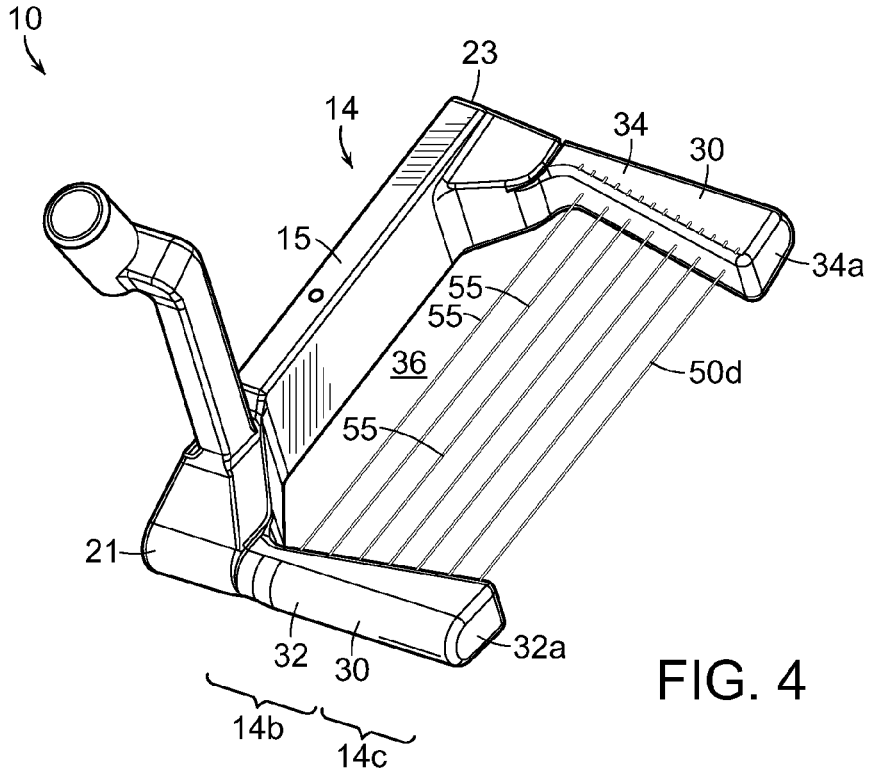
Figure 5:
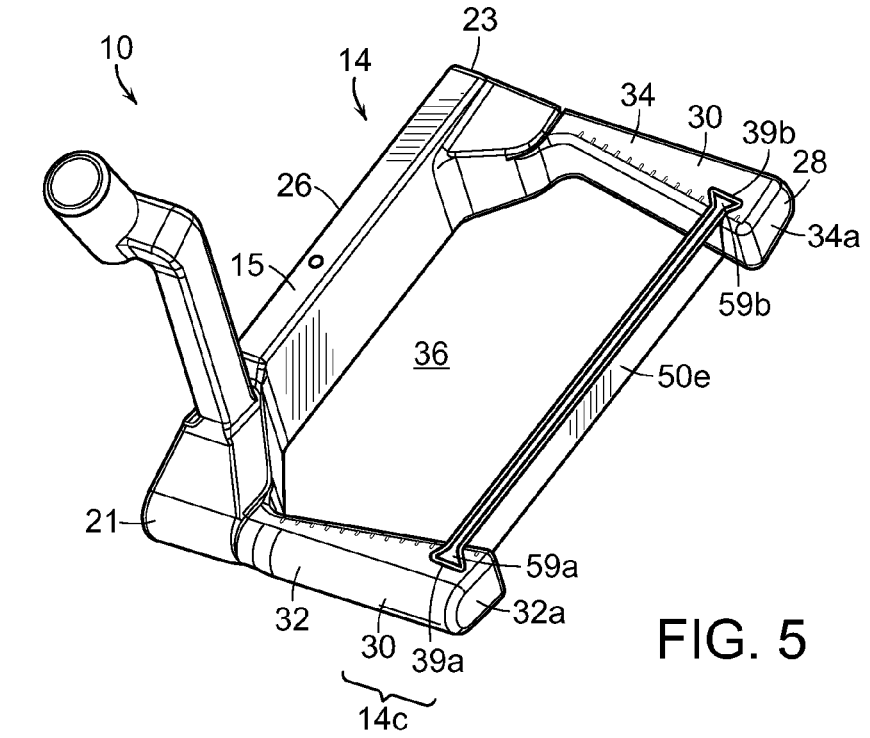

In FIG. 2, a two tension members 50 span gap 36 and are attached to arms 32, 34. Tension member 50*b* is formed of a plurality of strands 55 attached at first ends to an upper side of arm 32 and at opposing ends to an upper side of arm 34. In this particular embodiment, the strands 55 cross over one another. Further, tension member 50*b* extends along a majority of the breadthwise dimension of the arms 30. Specifically, tension member 50 is located in the mid-portion 14*b* and the rear portion 14*c* of arms 30. Similarly, tension member 50*c* is formed of a plurality of strands 55 attached at first ends to a lower side of arm 32 and at opposing ends to a lower side of arm 34. As with tension member 50*b*, in this particular embodiment, the strands 55 of tension member 50*c* cross over one another. In FIG. 3, only the first tension member 50*b*, with its plurality of crossed strands 55, is provided. In FIG. 4, a tension member 50*d*, provided as a plurality of strands 55 extends across gap 36. In this particular embodiment, strands 55 are not crossed, but rather extend straight across. Further, tension member 50*d* engages arms 32, 34 at a midpoint between the upper and lower surfaces of the arms 30. In the embodiment of FIG. 5, a thin, flexible plate provides tension member 50*e*. Tension member 50*e* is located in the rear portion 14*c* of arms 30. Further, tension member 50*e* has a constant cross-sectional area. It is understood that the connections between the ends of the tension members 50*a-e* and the arms 32, 34 are such that the members 50*a-e* may be provided with a desired amount of pre-tension. It is understood that the tension members 50*a-e* may utilize a tensioning mechanism to impart pre-tension to the members. In one exemplary embodiment, a turnbuckle device may be used with the tension members 50*a-e*. A ratchet-type mechanism may also be utilized. According to certain embodiments, tension members 50 may be attached to arms 32, 34 first and then subsequently subjected to further treatment to pre-tension the tension members 50. For example, tension member 50 may be formed of a shape-memory alloy.

In an alternative exemplary embodiment, the first arm 32 and the second arm 34 may have a plurality of openings through the arms 32, 34. A tension member such as tension member 50*b* may be utilized as a single strand of material. A first end of the tension member 50*b* may be anchored to one of the arms 32, 34. The tension member 50*b* then passes through the various openings in the arms 32, 34 based on the desired pathway of the tension member 50. The desired amount of pre-tension is applied to the tension member 50*b* and then a second end of the tension member 50 is affixed to one of the arms 32, 34. As discussed, a tensioning mechanism may be utilized with the tension member 50*b* and operably connected to the club head body 15 and the tension member 50*b*. The tensioning mechanism may be configured to allow the amount of pre-tension on the tension member 50*b* to be adjusted or set as desired. In addition, the openings in the arms 32, 34 can be structured or configured to relieve stresses on the tension member 50*b* around locations where the tension member 50*b* may wrap around the arms 32, 34 when passing through the openings.

Figure 6:
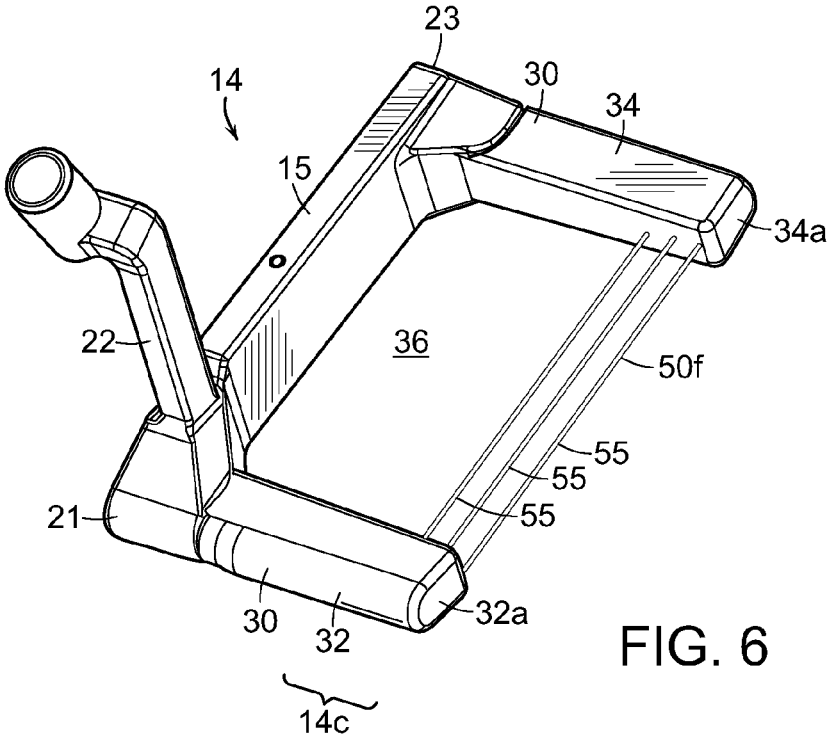
FIGS. 6 and 7 illustrate other various embodiments of golf club heads, taken from a rear perspective view, with tension members in accordance with certain aspects.
Figure 7:
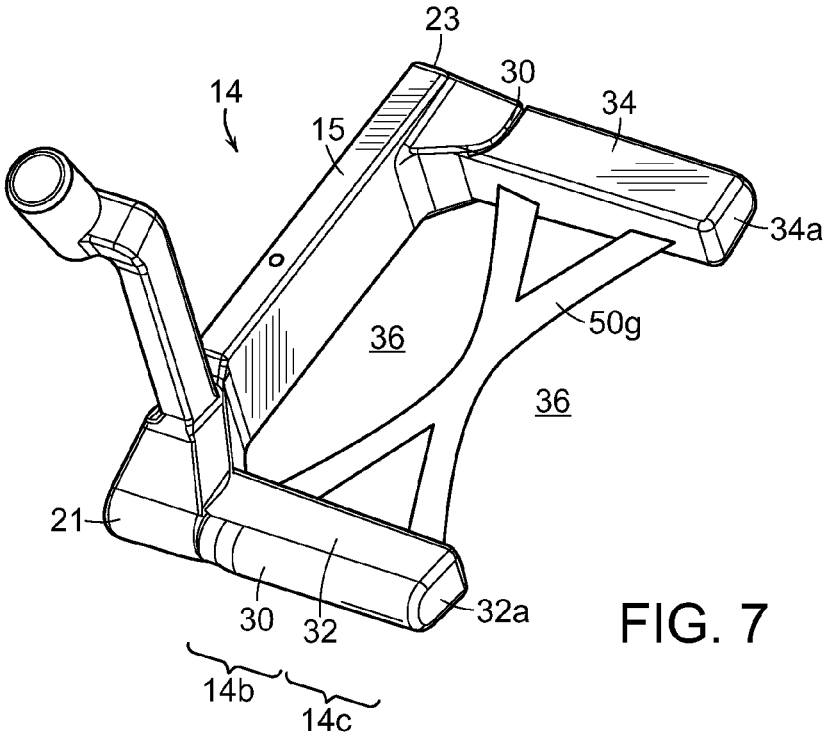

The embodiments of FIGS. 6 and 7 are similar to the embodiment of FIG. 2, with the exception that arms 30 maintain a substantially constant cross-sectional area as they extend toward the rear of club head 14. In FIG. 6, tension member 50*f* is provided as a set of three strands 55 located in the rear portion 14*c* of arms 30. In this embodiment, strands 55 are cables. In FIG. 7, tension member 50*g* is provided as a thin, relatively flexible tensioned plate forming an X-shape. Tension member 50*g* is located in the mid-portion 14*b* and rear portion 14*c* of club head 14.

Figure 8:
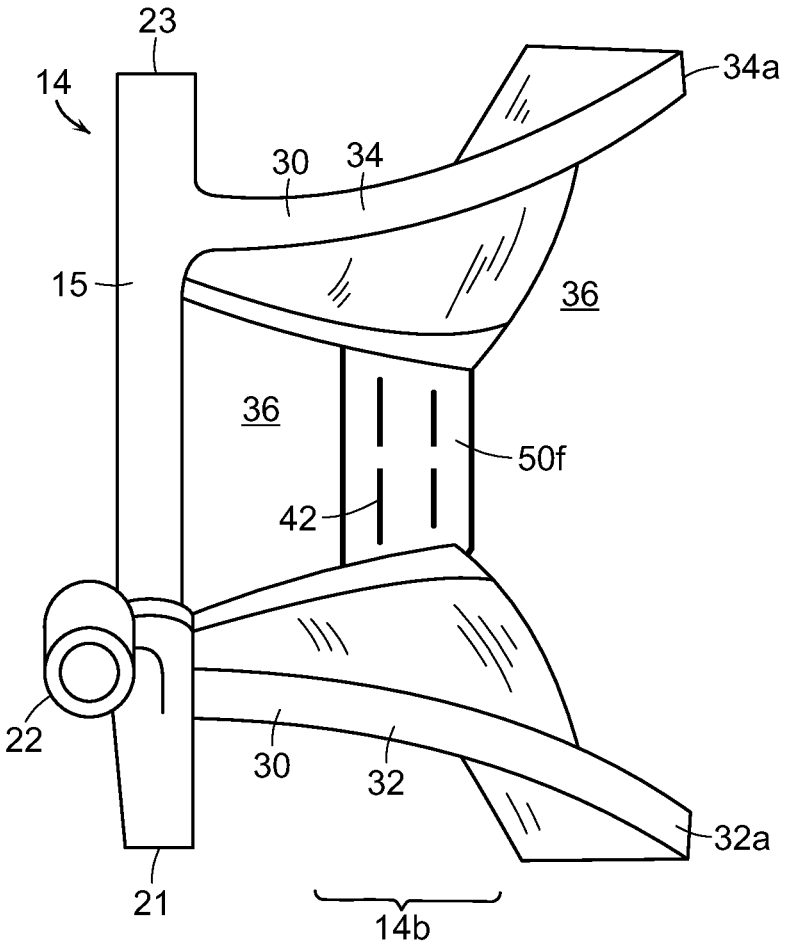
FIG. 8 is a top view of an alternative embodiment of a golf club head with a tension member in accordance with certain aspects.

In another embodiment, for example as shown in FIG. 8, arms 32 and 34 may have a generally rectangular cross-sectional shape from top to bottom. Further, arms 32, 34 may have a curved or twisted construction and generally extend rearward and outward (away from one another) with respect to a geometric center of the striking face 26. The arms 32 and 34 of this example bend outward away from each other and their lower edges are twisted outward at their rearward ends with respect to their upper edges. In this embodiment, arms 32 and 34 are joined to body 15 inboard of an outermost heel-side edge and inboard of an outermost toe-side edge. However, the free ends of arms 32, 34 lie outboard of the outermost heel-side edge and outermost toe-side edge of body 15. In other words, arms 32, 34 flare outward as they extend toward the rear of club head 14. In this embodiment, tension member 50*h* extends across gap 36 at a mid-portion of arms 32, 34. Tension member 50*h* may include at least one reinforced layer. As one example, tension member 50*h* may be formed as multiple reinforced composite layers laminated to form a somewhat flexible thin plate. As another example, tension member 50*h* may be formed as a wire reinforced fabric layer. Optionally, as shown, tension member 50*h* may be provided with an alignment indicator 42.

Tension member 50 may be engaged with the arms 32 and 34 in any desired manner without departing from this invention, such as via adhesives or cements, via mechanical connectors, etc. For example, threaded fasteners such as set screw may be used to retain tension member 50 to arms 32, 34 and also place tension member in a pre-tensioned condition. According to another embodiment, if desired, tension member 50 may fit into recessed areas provided in the surfaces of the arms 32 and 34. For example, referring to FIG. 5, arms 32 and 34 may be provided with slots 39*a*, 39*b* and the ends of tension member 50 may be provided with complementary sliding elements 59*a*, 59*b*. To engage tension member 50 with arms 32, 34, arms 32 and 34 may be squeezed together and sliding elements 59*a*, 59*b* may be slidingly engaged with slots 39*a*, 39*b*. During the sliding engagement of tension member 50 with arms 32, 34, tension member 50 is in a relaxed, non-tensioned condition. When arms 32 and 34 are released, slots 39*a*, 39*b* move apart, thereby moving the retained sliding elements 59*a*, 59*b* apart such that tension member 50 is placed in a pre-tension condition.

Thus, it is to be appreciated that in certain embodiments tension member 50 may be fixedly retained with respect to body 15 once the tension member 50 has been engaged to a desired position within arms 32 and 34. Suitable means of engaging and fixedly retaining tension member 50 to arms 32, 34 would be apparent to those skilled in the art, given the benefit of this disclosure. Further, it is to be appreciated that in certain embodiments, tension members may be detachably engaged to arms 32, 43. Providing tension member 50 with the ability to be decoupled from arms 32, 34 allows interchangeable tension members 50 to be attached and detached until the right feel for any individual golfer is achieved.

In other embodiments, a single arm may project rearwardly away from the ball striking surface of the golf club head body at generally a central location wherein a T-shaped body is formed. Tension members may be utilized between the single arm and the club head body proximate the ball striking surface.

It is expected that tensioning tension member 50 would increase the rigidity of the entire club head, thereby ameliorating undesired vibration characteristics sometimes experience by club heads provided with cantilevered arms.

In general, golf club head 14 may be any driver, wood, hybrid, iron, wedge, putter or the like. The golf club head 14 of FIG. 1A may be representative of a putter-type golf club head according to the invention. The putter head may be center shafted or heel shafted. Golf clubs and golf club heads, and particularly putters and putter heads, may have any desired constructions, materials, dimensions, loft angles, lie angles, colors, designs, and the like without departing from this invention, including conventional constructions, materials, dimensions, loft angles, lie angles, colors, designs, and the like, as are known and used in the art.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A golf club head comprising:

a body having a ball striking face for striking a golf ball, the body extending from a heel-side to a toe-side;

a first arm projecting in a rearward direction from the body;

a second arm projecting in the rearward direction from the body;

the second arm spaced from the first arm in a heel-to-toe direction to thereby define a gap; and a tension member spanning the gap and having a first end attached to a first point partway along the first arm and a second end attached to a second point partway along the second arm, wherein a portion of the first arm projects in the rearward direction beyond the tension member to a first end and a portion of the second arm projects in the rearward direction beyond the tension member to a second end, wherein the first end is not connected to the second end such that the first arm is connected to the second arm only by the body and the tension member, wherein the tension member is pre-tensioned such that the tension member is held in tension between the first arm and the second arm.

2. The golf club head of claim 1, wherein the tension member is non-load carrying when in a non-tensioned state.

3. The golf club head of claim 1, wherein the tension member includes at least one strand.

4. The golf club head of claim 1, wherein the tension member includes a plurality of strands.

5. The golf club head of claim 1, wherein the tension member includes a reinforced composite material.

6. The golf club head of claim 1, wherein the tension member is a rod-like element.

7. The golf club head of claim 1, wherein the tension member is a plate-like element.

8. The golf club head of claim 1, wherein the tension member is detachably attached to the first and second arms.

9. The golf club head of claim 1, further including a second tension member having a first end attached to the first arm and a second end attached to the second arm.

10. The golf club head of claim 1, wherein the tension member is pre-tensioned from approximately 500 N to approximately 4500 N.

11. The golf club head of claim 1, wherein a rearward end of at least one of the arms is located at least 30 mm in a breadthwise direction from the striking face of the body.

12. The golf club head of claim 1, further comprising an intermediate plate extending between the first arm and the second arm.

13. The golf club head of claim 12, further comprising an alignment indicator on the intermediate plate.

14. The golf club head of claim 1, wherein the club head is a putter head.

15. The golf club head of claim 9, wherein the first and second arms are configured to engage and retain the first and second ends of the second tension member interchangeably with the first tension member.

16. A golf club assembly comprising:

a shaft; and a club head secured to a first end of the shaft and comprising:

a body having a striking face for engaging a golf ball, the body extending from a heel-side to a toe-side;

a hosel, proximate a front plane at the heel-side of the body;

a first arm projecting rearwardly from the body;

a second arm projecting rearwardly from the body;

the second arm spaced from the first arm in a heel-to-toe direction to thereby define a gap; and a tension member spanning the gap and having a first end attached to a first point partway along the first arm and a second end attached to a second point partway along the second arm; and wherein the first arm projects rearwardly beyond the tension member to a first end and the second arm projects rearwardly beyond the tension member to a second end, wherein the first end is not connected to the second end such that the first arm is connected to the second arm only by the body and the tension member, and wherein the tension member is pre-tensioned.

17. The golf club head of claim 16, wherein the tension member includes a plurality of wires.

18. The golf club head of claim 16, wherein the tension member is detachably attached to the first and second arms.

19. The golf club head of claim 16, further including a second tension member having a first end attached to the first arm and a second end attached to the second arm.

20. The golf club assembly of claim 16, wherein a rearward end of at least one of the arms is located at least 30 mm in a breadthwise direction from the striking face of the body.

* * * * *